US005345996A

United States Patent [19]

Druien

[11] Patent Number: 5,345,996

[45] Date of Patent: Sep. 13, 1994

[54] ENERGY SAVING WATER AND AIR BUBBLE HEAT MAXIMIZER FOR SWIMMING POOLS, HOT TUBS, AND SPAS

[76] Inventor: Robert H. Druien, 6128 Heather St., Palm Beach Gardens, Fla. 33418

[21] Appl. No.: 53,720

[22] Filed: Apr. 27, 1993

[51] Int. Cl.[5] ..... A61H 33/02

[52] U.S. Cl. ..... 165/47; 165/909; 4/545; 4/541.2; 4/541.5; 122/421; 122/439

[58] Field of Search ..... 165/901, 909, 47; 122/421, 439, 444, DIG. 1; 4/545, 541.5, 541.2

[56] References Cited

U.S. PATENT DOCUMENTS

| | | | |
|---|---|---|---|
| 3,838,666 | 10/1974 | Smith | 122/DIG. 1 |
| 4,037,567 | 7/1977 | Torres | 122/421 |
| 4,175,518 | 11/1979 | Reames, Jr. | 122/421 |
| 4,342,359 | 8/1982 | Baker | 165/47 |
| 4,550,772 | 11/1985 | Knoch | 165/47 |
| 4,580,621 | 4/1986 | Lovrich et al. | 165/47 |
| 4,629,117 | 12/1986 | Kasbohm | 237/55 |
| 4,766,952 | 8/1988 | Onodera | 165/95 |
| 4,899,401 | 2/1990 | Savarese | 4/542 |
| 5,095,559 | 3/1992 | Liljegren et al. | 4/542 |
| 5,172,754 | 12/1992 | Graber et al. | 165/47 |

*Primary Examiner*—Albert W. Davis, Jr.
*Attorney, Agent, or Firm*—John C. Smith

[57] ABSTRACT

An adjustable, energy saving, high speed, air bubble and water heating system extracts waste heat from the exhaust of a water heater on a swimming pool, hot tub, or spa to heat air and/or water. The use of the waste heat results in accelerated heating of the water and creation of heated air bubbles without any additional heat energy requirements. The temperature of the water and air bubbles is independently controllable via manual controls or automatic thermostat.

13 Claims, 7 Drawing Sheets

ENERGY SAVING WATER AND AIR BUBBLE HEAT MAXIMIZER FOR SWIMMING POOLS, HOT TUBS, AND SPAS

BACKGROUND OF THE INVENTION

1. Technical Field

The present invention relates to heating equipment for swimming pools, hot tubs, and spas. In particular, heating equipment which utilize reclaimed waste heat to accelerate the heating of air bubbles and water in swimming pools, hot tubs, and spas.

2. Background Art

Swimming pools, hot tubs, and spas have come into widespread use both for recreational and health related purposes. Depending on the geographic location, the usable season for water related activities may be severely limited due to weather. The prior art has extended the usable season by providing water heaters which allow an individual to comfortably use these pools, hot tubs, and spas outside of their normal usable season. In many climates, water heaters make possible year round use. Heaters can use a variety of fuel types such as solar, electric, oil, or gas.

In hot tubs and spas, which use air bubbles, the injection of ambient air in cold weather adversely affects comfort due to direct contact with the air bubbles by an individual and also due to the lowering of water temperature by the cold air. Further, by lowering water temperature, the ambient air increases the amount of energy used by the heater to maintain a constant water temperature. Attempts to solve this problem have been made using separate air furnaces to heat air prior to injection into the hot tub or spa.

Serious disadvantages to the use of the heaters is the high cost of energy required to heat large volumes of water, and the long burn times required for the heaters to raise the temperature to a comfortable level. In addition, systems using air bubbles, such as hot tubs and spas, compound the problems associated with heating water. In these systems, either the cold air bubbles increase the amount of burn time required for the water heater to maintain temperature, or a separate furnace is required to heat the air bubbles. In either case, a large amount of energy is used. Extended time periods are also necessary to heat the water, resulting in undesirable delays when an individual decides to use the spa until it can comfortably be entered. In addition, adjustable temperature control of air bubbles by an individual to suit that persons particular comfort level is not available.

The prior art has failed to provide an efficient heating system for water facilities capable of high speed, low energy heating of both water and air wherein both water and air temperature are individually controllable to the comfort of the user. In addition, the prior art has not shown a system capable of providing air bubbles without an increase in energy usage.

SUMMARY OF THE INVENTION

The user controllable, energy saving, high speed, air bubble and water heating system provided by this invention is the use of a waste heat reclamation device on the exhaust of the water heater to heat air and/or water resulting in accelerated heating of the water and creation of heated air bubbles without any additional heat energy requirements. The temperature of the water and air bubbles is independently controllable via manual controls or automatic thermostat.

DESCRIPTION OF THE PREFERRED EMBODIMENT

For ease of discussion, swimming pools, hot tubs, and spas will be referred to collectively as spas unless there are unique circumstances which require a separate discussion of the swimming pool, hot tub, or spa. Further, the conduit sections 118, 120, 122, 124, 126, 128, 130, 132, and 134 were identified as separate conduits to facilitate discussion. However, those skilled in the art will recognize that separately identified sections of conduit, such as conduit 126, conduit 128 and conduit 130 may be a single physical conduit.

Figure 1:
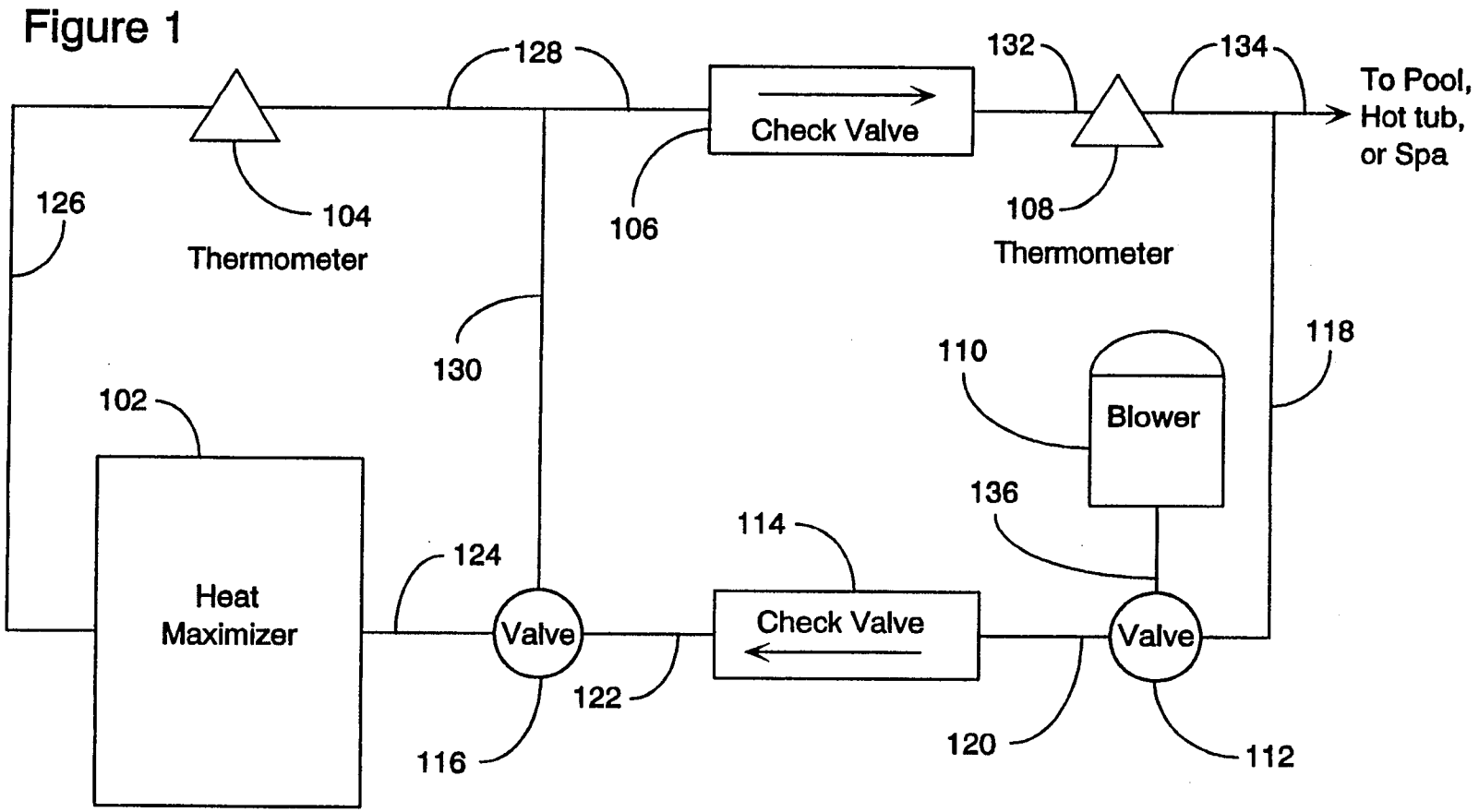
FIG. 1 is a diagram showing the air heating system of the present invention.

Referring to FIG. 1, blower 110 provides a source of air pressure to force the creation of bubbles when the air is expelled into the spa (not shown). Air from the output of the blower passes through conduit 136 to Three Way Jandy Valve (hereinafter "Valve") 112. Jandy valves are commonly used in the spa industry and are commercially available from Jandy Industries, Inc. among other sources. In the event the heat maximizer 102 is turned off, Valve 112 may be set to route air directly to conduit 118 which is connected to conduit 134. Conduit 134 routes the air received from conduit 118 to the spa. This allows individuals to have the pleasure of the bubbling air when they do not desire to heat the air entering the spa.

Air from conduit 118 is prevented from entering conduit 128 via conduit 132 by check valve 106. Check valve 106 thus ensures a one way flow of air from conduit 128 to conduit 132. In the preferred embodiment, check valves 106 and 114 are commercially available half pound pressure valves. Those skilled in the art will recognize that the pressure strength of check valves 106 and 114 may vary depending on the particular components selected for the system.

When heated air is desired, valve 112 is set to route air from conduit 136 to conduit 120. The air exits conduit 120 into check valve 114. Check valve 114 operates as a safety device. In the event blower 110 is turned off and heater 202 (shown in FIG. 2) is on, check valve 114 prevents heat from entering and possibly damaging blower 110. Air exits check valve 114 into conduit 122. Valve 116 is attached to the output of conduit 122. To maximize the air temperature, value 116 is set to route all of the air to conduit 124. From conduit 124, the air is input to heat maximizer 102. Heat maximizer 102 is explained in greater detail below. Heat maximizer 102 outputs heated air into conduit 126.

The heated air in conduit 126 flows into conduit 128. Optional thermometer 104 has a temperature sensor in the air path of conduits 126, and 128. Thermometer 104 is used to indicate the output temperature of air from heat maximizer 102. In addition, in the situation where heat maximizer 102 is being used and thermometer 104 does not indicate a rise in air temperature, a malfunction such as a leak or blockage of airflow is indicated.

Airflow in conduit 128 will not enter conduit 130 because valve 116 is closed for maximum airflow. The heated air from conduit 128 then passes through check valve 106, enters conduit 132, passes thermometer 108, enters conduit 134, and finally exits conduit 134 which is attached to the spa. Heated air will not enter conduit 118 because valve 112 is closed to conduit 118.

Thermometer 108 indicates the temperature of the heated air as it is passed to the spa. An individual can control the temperature of the air entering the spa in the following manner. valve 116 can be set such that it allows part of the input air to proceed to the heat maximizer 102 and the remainder of the air to bypass the heat maximizer 102 via conduit 130. This permits a mixture of heated air from conduit 126 and cool ambient air from conduit 122 by way of conduit 130 to mix in conduit 128, thereby regulating the temperature of the air flowing through conduit 128 to conduits 132 and 134.

Those skilled in the art will recognize that in addition to manual adjustment of the air temperature, a variety of commonly available thermostats and valve controls such as stepper motors can be used in conjunction with thermometer 108 and valve 116 to automatically control the temperature of air exiting conduit 134 to the spa. Thermometer 108 could in fact be replaced by a thermostat for direct automatic control of an electronically controlled valve with a stepper motor. As a result, an individual can control the temperature of the air entering the spa, thereby avoiding the discomfort of cold air being disbursed from the spa air channels.

Spa water is typically heated to temperatures exceeding one hundred degrees fahrenheit, usually in the one hundred four to one hundred and five degrees fahrenheit range. Ambient air is typically much colder. For example, if ambient air is sixty degrees, blower 110 will inject air into the one hundred and five degree water which is forty five degrees cooler. In addition to the obvious discomfort this causes, the water temperature is cooled causing heater 202 to burn longer and/or more frequently. By injecting heated air, heater 202 runs less frequently and uses less energy. In addition, since heater 202 does not have to overcome the temperature loss from cold ambient air, the spa heats more quickly and the individual can utilize the spa sooner.

An important feature of this invention is the fact that the air output from conduit 134 is heated with waste heat from heater 202. No energy is expended to heat the air because the heat maximizer 102 extracts heat from the exhaust of heater 202. Further, no additional energy is expended to move the air through heat maximizer 102 because the same blower 110 is used to move air through heat maximizer 102 which would normally move air directly to the spa through conduits 118 and 134. Therefore, another principle advantage of this invention is achieved by effectively heating air without any additional energy costs.

Figure 2:
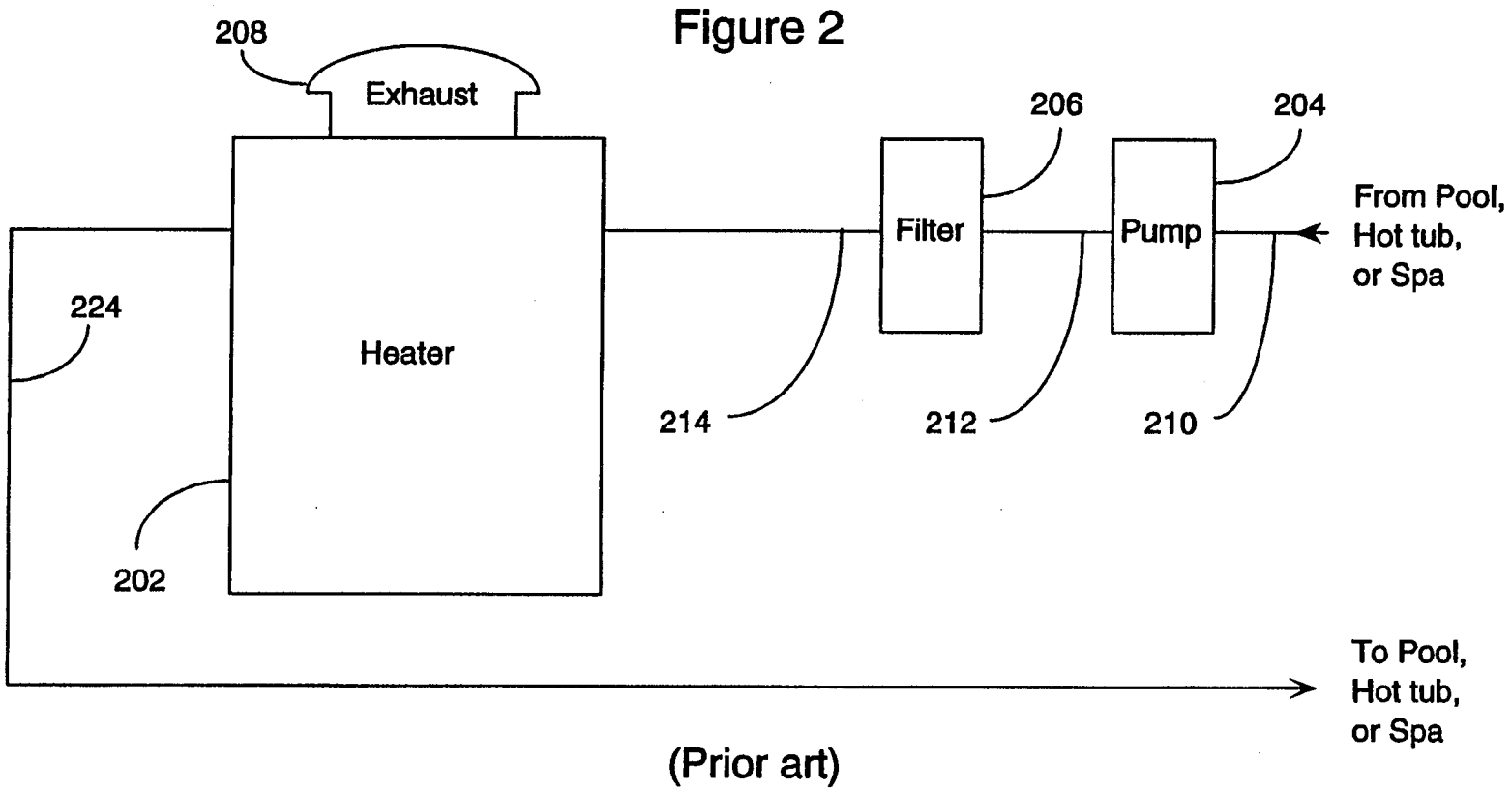
Figure 2 (Prior art)
FIG. 2 is a diagram of a prior art water heating system.

In FIG. 2, a water heating system typical of the prior art is shown. Water is drawn from the spa by the Pump 204 via conduit 210. The pump 204 outputs water into conduit 212 to filter 206. The filtered water is output via conduit 214 to heater 202. The heater 202 which would heat the water and return it via conduits 222 and 224 to the spa. Heater 202 is typically be gas burning, but other fuel types are available. Due to inefficiencies in the heater 202, a considerable amount of waste heat is lost through exhaust 208.

Figure 3:
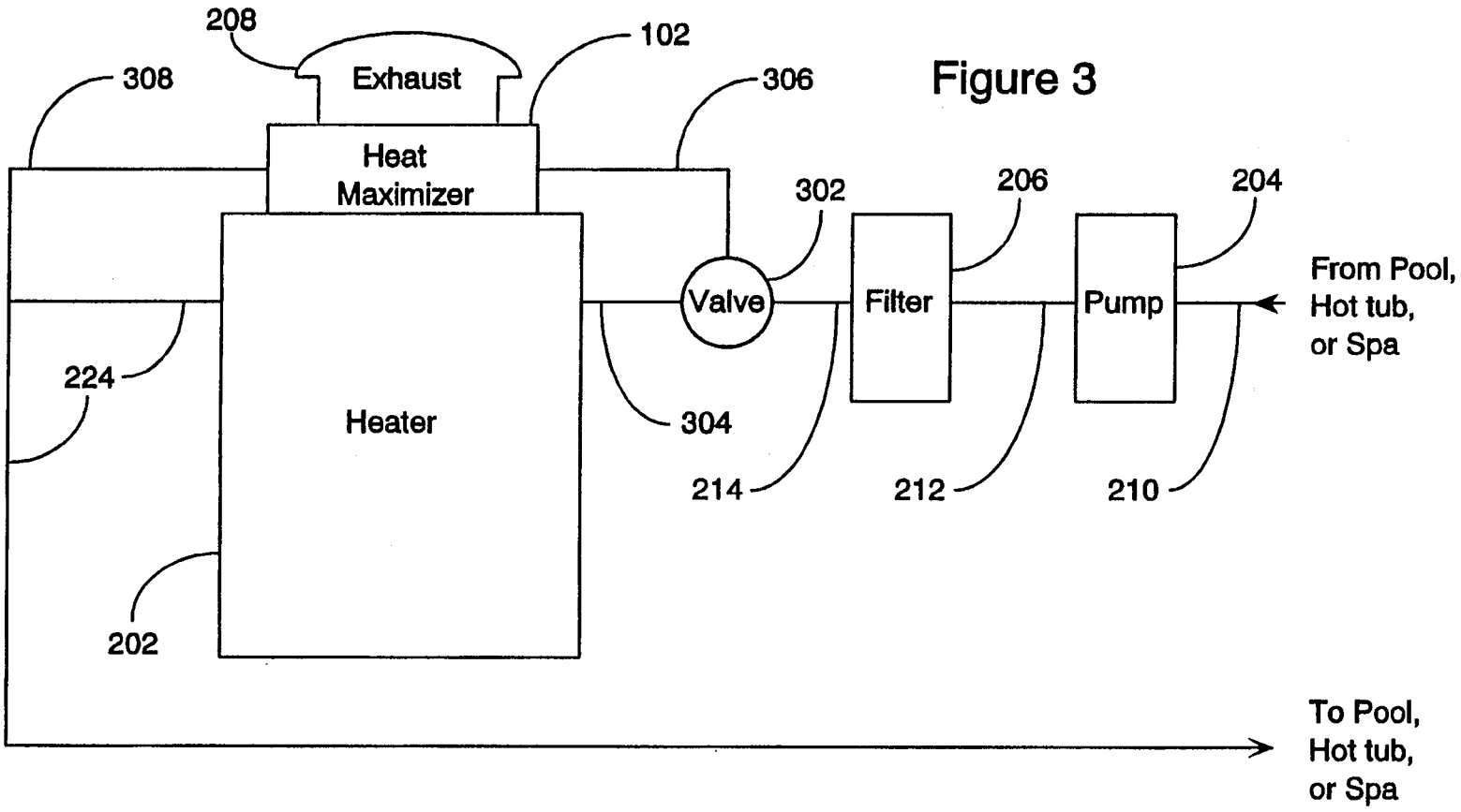
FIG. 3 is a diagram of the water heating system of the present invention.

FIG. 3 shows the water heating system of the present invention. A heat maximizer 102 is positioned between the heater 202 and the exhaust 208. Heat maximizer 102 extracts waste heat from gases exhausted by heater 202 (heat maximizer 102 is explained in greater detail in the discussion of FIGS. 4, 5, and 6).

Conduit 214 outputs water to Jandy 302. Jandy 302 is set such that the water flow is divided. Part of the water flow is output by Valve 302 into conduit 304 and is subsequently input to heater 202. The water is heated and output to conduit 224. A second stream of water is diverted by Valve 302 to heat maximizer 102 via conduit 306. Heat maximizer 102 heats the water with waste heat and outputs the water to conduit 308. The heated water in conduit 308 merges with heated water in conduit 224 and the combined water streams are returned to the spa via conduit 224. Those skilled in the art will recognize that the streams of water in conduits 308 and 224 could also be returned to the spa without being merged into a single conduit.

By using the waste heat which would otherwise be vented through exhaust 208, substantial decreases in heater 202 burn time can be achieved. Of course, the decrease in burn time results both in a reduction in operating costs and a reduction in the environmental pollution due to the decreased consumption of fuel.

Figure 4:
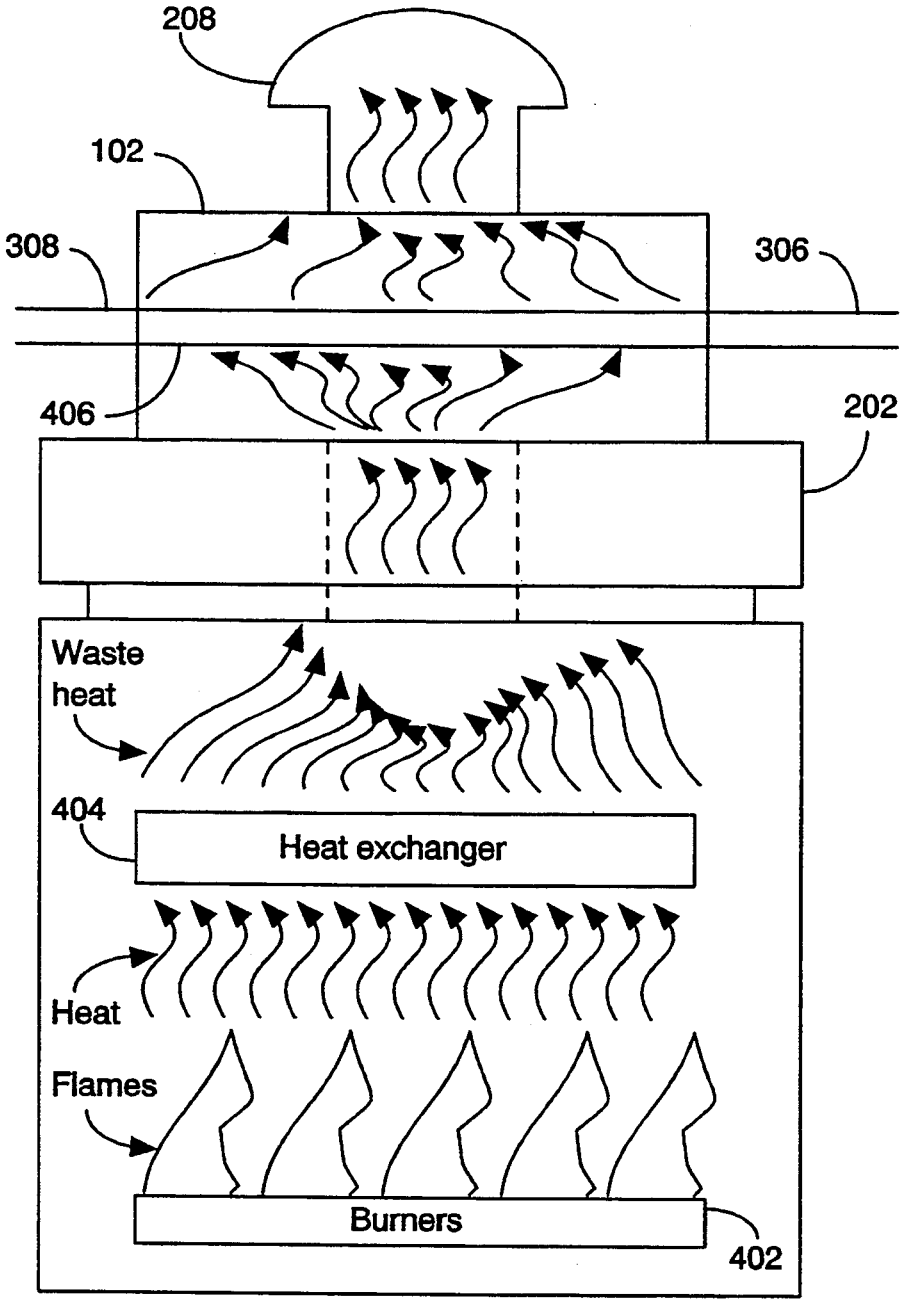
FIG. 4 is a cross sectional view showing heat flow when the invention is used to heat water.

FIG. 4 is a cross sectional view showing heat flow through heater 202, heat maximizer 102, and exhaust 208. Burners 402 provide heat in the form or flames shown at the bottom of FIG. 4. The flames create heated fumes which are used by heat exchanger 404 to heat the water for the spa. However, not all of the heat is captured by the heat exchanger 404. A substantial amount of waste heat escapes through the exhaust 208.

As can be seen in FIG. 4, heat maximizer 102 of the instant invention is positioned in the exhaust heat path. When waste heat rising through the exhaust enters the inner chamber of heat maximizer 102, it passes over the heat extractor 406. Water input from conduit 306 is channeled through the interior of heat extractor 406. The water absorbs waste heat and is output as heated water from heat extractor 406 into conduit 308.

The amount of waste heat reclaimed by heat extractor 406 will vary based on several factors. For example, the particular physical configuration used by heat extractor 406, such as the number of conduits, the diameter of the conduits (i.e., the surface area of the conduits in relation to the amount of water carried) will alter the amount of heat extracted. Likewise, the use of insulation in the interior of the heat maximizer 102 will aid the retention of heat in the interior of the heat maximizer 102, and further increase the warming of the water (or any other heat transfer material such as air). Those skilled in the art will recognize that the particular size, complexity of conduit layout, and amount of insulation will vary based on the size of the units in question and the particular application.

FIG. 4 shows waste heat recovery for water. The procedure for waste heat recovery for air is identical to that used in FIG. 4. The only change required is to replace conduits 306 and 308 with conduits 124 and 126, respectively. In this regard, a heat maximizer 102 with a single internal heat extractor 406 or 502 could be used interchangeably for any heat transfer material such as air or water. The only change would be the attachment of either conduits 124 and 126 for air or conduits 306 and 308 for water.

As can be seen in FIG. 4, an additional benefit of the placement of the heat maximizer 102 on the top of the heater 202 is that it increases the distance between the exhaust 208 and burners 402. The increase in distance reduces the likelihood that a backdraft will extinguish the pilot light (not shown) in the burners 402.

Figure 5:
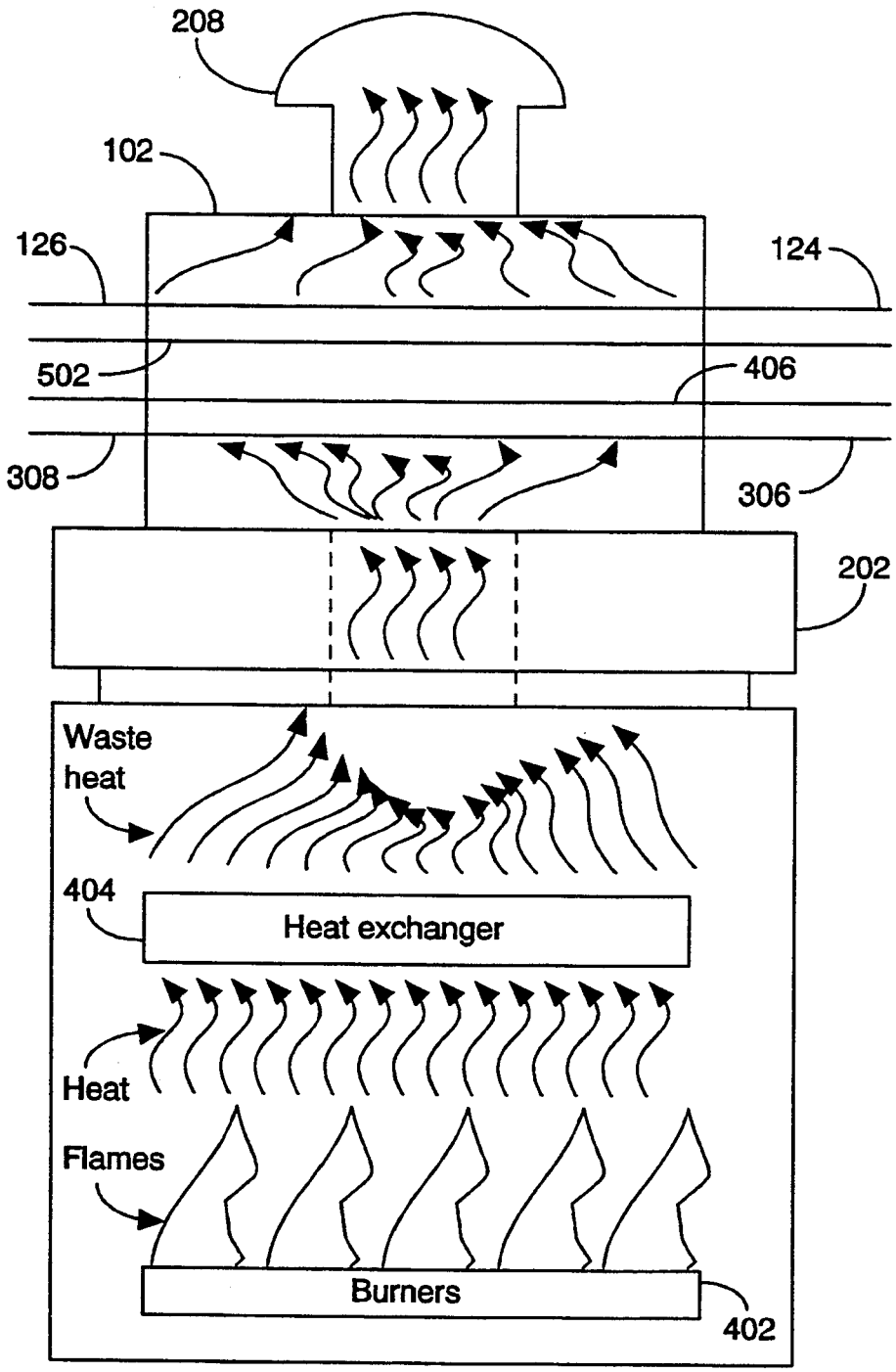
FIG. 5 is a cross sectional view showing heat flow when the invention is used to heat air and water.

FIG. 5 shows the same configuration as FIG. 4, with the following exceptions. A second heat extractor 502 is added to accommodate air heating. Input conduit 124 supplies ambient air to second heat extractor 502 and output conduit 126 receives heated air output by second heat extractor 502. This configuration extracts waste heat for simultaneous and independent heating of air and water.

Figure 6:
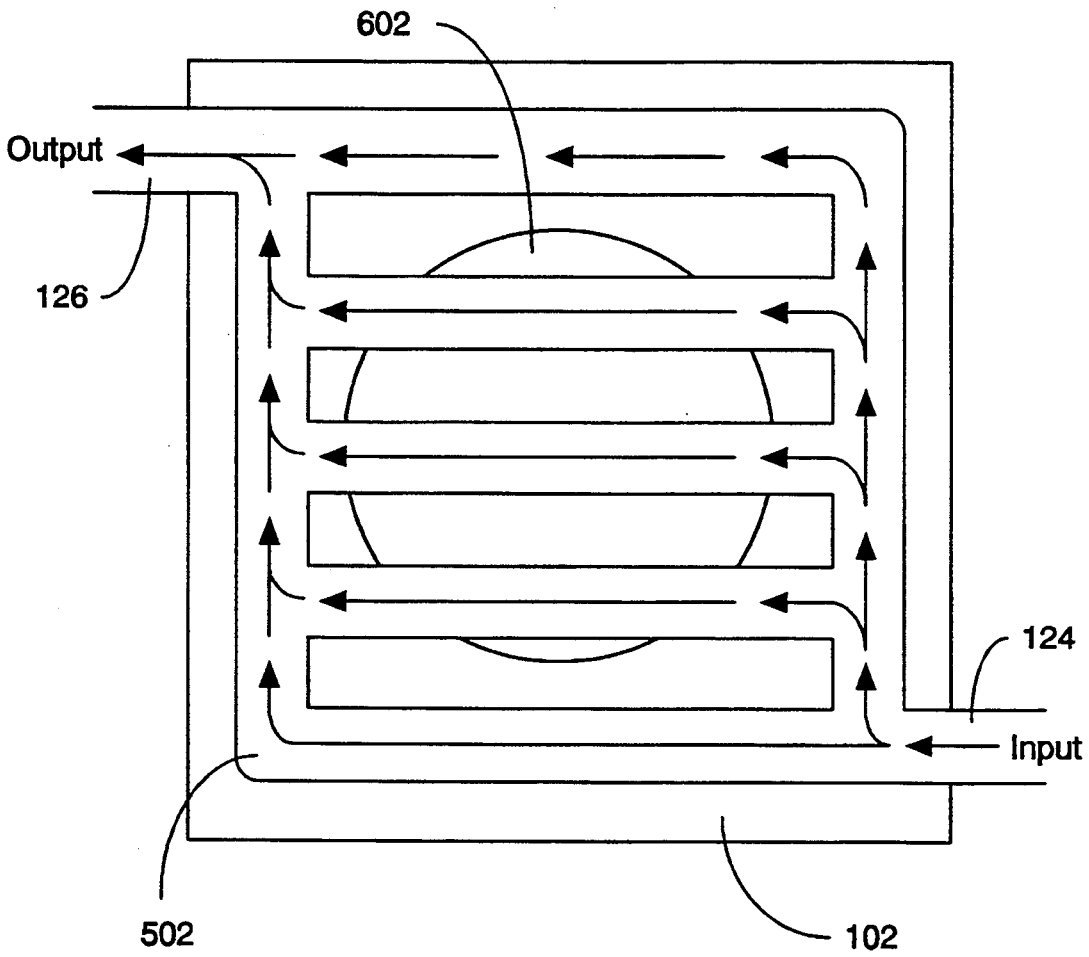
FIG. 6 is a top plan cross sectional view of the heat maximizer.

FIG. 6 is a top plan cross sectional view of heat maximizer 102. The location of an exhaust input 602, second heat extractor 502, input conduit 124, and output conduit 126 in relation to heat maximizer 102 are shown. As can be seen, second heat extractor 502 is directly in the path of the waste heat from heater 202 which enters heat maximizer 102 through the exhaust input 602. After the waste heat passes heat extractor 502, it continues to exhaust output 706 (shown in FIG. 7). For ease of illustration, a simple arrangement of conduits in second heat extractor 502 is shown. Those skilled in the art will recognize that any number of conduit layouts may be made to maximize the amount of heat absorbed as long as adequate space is left for exhaust flow. Likewise, heat extractor 406, which is shown in FIGS. 4 and 5 would occupy space within the enclosure of heat maximizer 102. The location of heat extractor 406 in relation to second heat extractor 502 is not important so long as they do not interfere with one another or cause an obstruction to exhaust flow in the chamber of heat maximizer 102. Exhaust input 602 and exhaust out 706 need not take any particular shape such as the circular arrangement shown. They may even be mere apertures rather that the extended forms shown in FIG. 7 as exhaust input 602 and exhaust output 706. The only requirement is that they provide for adequate exhaust flow. Further, the location of the input and output ports for conduits 124, 126, 306, and 308 can be anywhere on heat maximizer 102 that is convenient.

Figure 7:
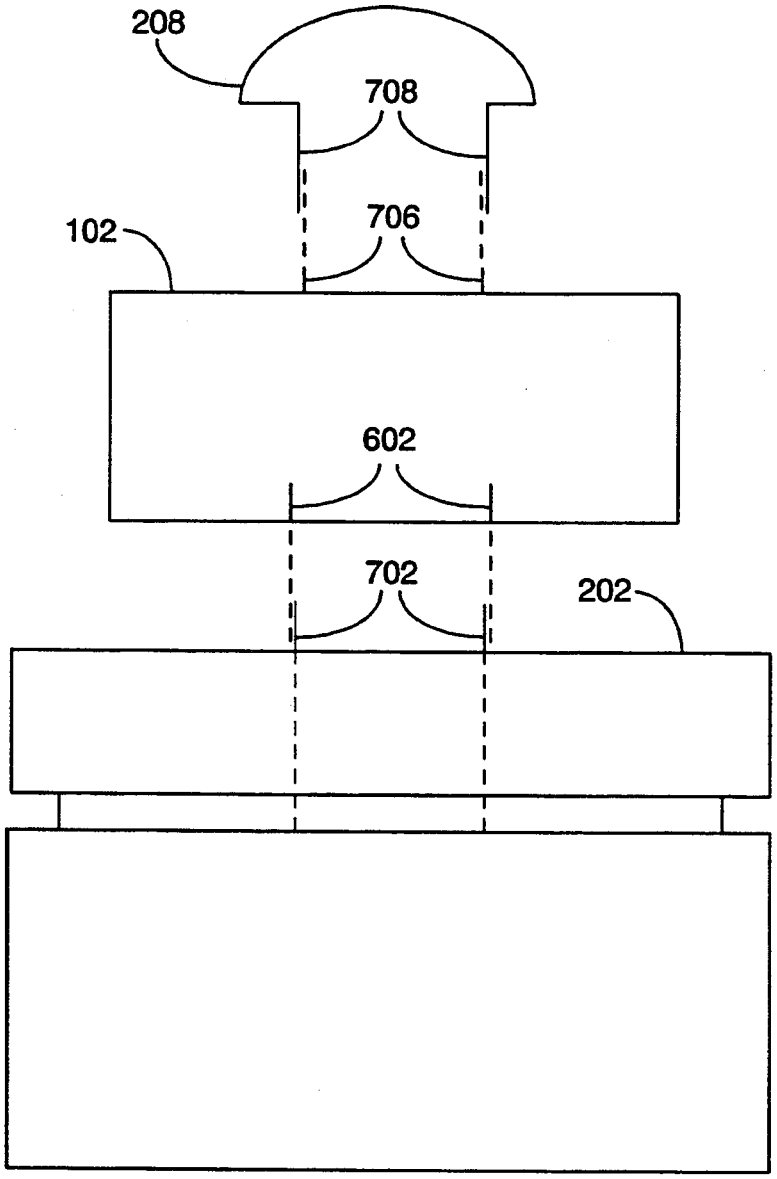
FIG. 7 is an exploded view of the heat maximizer as it connects to the heater and the exhaust.

To simplify discussion, heat maximizer 102 has been shown so far as an integrated device within the overall spa heating system. FIG. 7 shows another embodiment of the invention which is designed for attachment to preexisting heaters. In addition, it may even be added on to units temporarily for use as a demonstration model for prospective sales, or for temporary use by its owner, etc. The stem of exhaust 208 is severed, such that a bottom portion 702 remains attached to heater 202. An upper portion 708 of the stem of exhaust 208 remains on exhaust 208. Heat maximizer 102 has an exhaust input 602 which is large enough to accommodate bottom portion 702. Bottom portion 702 fits inside of exhaust input 602 to ensure that exhaust gases from heater 202 are directed into heat maximizer 102. The top of heat maximizer 102 has an exhaust output 706. Likewise, second fitting 706 is sized to fit within the upper portion 708 to direct exhaust gases through exhaust 208. Those skilled in the art will recognize that it is also possible to fit heat extractor 102 between heater 202 and exhaust 208 without severing the stem 702, 708 of exhaust 208.

For ease of illustration, a small heater 202 and heat maximizer 102 which would typically be used in a residential environment are shown. In actual use, there is no limitation on size. For example, units can be designed for not only for residential use, but also for large commercial applications such as hotels, hospitals, or the like.

The materials used inside heat maximizer 102 can be any suitable material which can satisfactorily perform in the heat encountered in the interior of heat maximizer 102. A typical material useful for heat extractor 406 or second heat extractor 502 would be copper, although other materials can be substituted. The fittings to connect the heat extractors to conduits 124, 126, 306, and 308 can also be made from any suitable material. For example, commonly available CPVC fittings, which are designed for high temperature operation, can be used.

While the invention has been described with respect to a preferred embodiment thereof, it will be understood by those skilled in the art that various changes in detail my be made therein without departing from the spirit, scope, and teaching of the invention. For example, numerous materials can be used so long as they are suitable for high temperature use. Likewise, many different configurations of heat extractor layout can be used. Valve controls can be manual or automatic, etc. Accordingly, the invention herein disclosed is to be limited only as specified in the following claims.

I claim:

1. A method for reclaiming waste heat from a heater for a bathing facility such as a spa, tub, or pool, the method including the steps of:

locating a secondary heat extractor in the exhaust path of the heater;

moving air to the input of the secondary heat extractor;

heating the air as it passes through the secondary heat extractor; and moving the heated air from the output of the secondary heat extractor to the spa, tub, or pool.

2. A method as in claim 1, further including the steps of:

measuring air temperature prior to injection of the air into the spa, tub, or pool; bypassing a portion of the air around the secondary heat extractor with valve means such that the temperature of air entering the spa, tub, or pool can be adjusted.

3. A method as in claim 1, further including the steps of:

using a thermostat to measure air temperature prior to injection into the spa, tub, or pool;

providing a bypass conduit to bypass a portion of the air around the secondary heat extractor;

controlling automatic valve means with the thermostat to divert some air to the bypass conduit such that the temperature of air entering the spa, tub, or pool can be automatically maintained.

4. The method of claim 1, further including the step of attaching the secondary heat extractor such that it is removably attachable to the heater.

5. A system for heating air bubbles and water with reclaimed waste heat from a heater for a bathing facility such as a spa, tub, or pool, the system comprising:

a heat extractor attached to the exhaust of the heater, the heat extractor further comprising:

a secondary heat extractor having an air input, an air output, and air conduit means connecting the air input to the air output; and a tertiary heat extractor having a water input, a water output, and water conduit means connecting the water input to the water output;

an input air conduit to provide a path for ambient air to the air input of the secondary heat extractor;

an output air conduit to provide a path for heated air from the air output of the secondary heat extractor to the spa, tub, or pool;

an input water conduit to provide a path for water from the spa, tub, or pool to the water input of the tertiary heat extractor;

an output water conduit to provide a path for heated water from the water output of the tertiary heat extractor to the spa, tub, or pool;

blower means for moving air through the input air conduit, the secondary heat extractor, and the output air conduit; and pump means for moving water through the input water conduit, the tertiary heat extractor, and the output water conduit.

6. A system as in claim 5, further comprising:

a thermometer to measure air temperature prior to injection of the air into the spa, tub, or pool;

a bypass conduit to provide a bypass air path around the secondary heat extractor; and valve means to divert some air to the bypass conduit such that the temperature of air entering the spa, tub, or pool can be adjusted.

7. A system as in claim 5, further comprising:

a thermostat to regulate air temperature prior to injection of the air into the spa, tub, or pool;

a bypass conduit to provide a bypass air path around the secondary heat extractor; and automatic valve means under control of the thermostat to divert some air to the bypass conduit such that the temperature of air entering the spa, tub, or pool can be automatically maintained.

8. The system of claim 5, wherein the heat extractor is removably attachable to the heater.

9. A heat maximizer for reclaiming waste heat from a heater for a bathing facility such as a spa, tub, or pool, the heat maximizer comprising:

a heater;

an exhaust input to receive heated fumes containing waste heat exhausted from the heater; a secondary heat extractor positioned in the exhaust path of the heated fumes received by the exhaust input, the heat extractor further comprising at least one heat transfer conduit, at least one input for inputting air into the heat transfer conduit and at least one output for outputting air from the heat transfer conduit to the bathing facility; and an exhaust output to vent the heated fumes after the waste heat has been extracted.

10. A heat maximizer, as in claim 9, further comprising:

a tertiary heat extractor positioned in the path of the waste heat produced by the heater, the tertiary heat extractor further comprising at least one heat transfer conduit, at least one input for inputting water into the heat transfer conduit and at least one output for outputting water from the heat transfer conduit.

11. A heat maximizer, as in claim 10, wherein air and water are heated simultaneously.

12. A heat maximizer, as in claim 11, wherein:

the heat transfer material heated by the secondary heat extractor is air; and the heat transfer material heated by the tertiary heat extractor is water.

13. A heat maximizer, as in claim 9, wherein the heat extractor is removably attachable to the heater.

* * * * *